US005950557A

United States Patent [19]

Georgii

[11] Patent Number: 5,950,557

[45] Date of Patent: Sep. 14, 1999

[54] INSTALLATION FOR OFFSHORE STORAGE OF HAZARDOUS WASTE

[75] Inventor: Hans Georgii, London, United Kingdom

[73] Assignee: Hydro Betong AB, Stockholm, Sweden

[21] Appl. No.: 08/952,680

[22] PCT Filed: May 14, 1996

[86] PCT No.: PCT/SE96/00624

§ 371 Date: Nov. 14, 1997

§ 102(e) Date: Nov. 14, 1997

[87] PCT Pub. No.: WO96/36974

PCT Pub. Date: Nov. 21, 1996

[30] Foreign Application Priority Data

May 15, 1995 [SE] Sweden ..... 9501796

[51] Int. Cl.[6] ..... B65D 88/78

[52] U.S. Cl. ..... 114/257

[58] Field of Search ..... 114/256, 257, 114/264, 265, 266

[56] References Cited

U.S. PATENT DOCUMENTS

| | | | |
|---|---|---|---|
| 3,557,396 | 1/1971 | Rupp | 114/257 |
| 3,568,737 | 3/1971 | Burns | 114/257 |
| 3,686,886 | 8/1972 | Georgii . | |
| 3,760,753 | 9/1973 | Mertens | 114/257 |
| 3,855,809 | 12/1974 | Westling | 114/257 |
| 4,307,679 | 12/1981 | Goldsberry et al. | 114/257 |
| 4,556,002 | 12/1985 | Georgii . | |

FOREIGN PATENT DOCUMENTS

| | | |
|---|---|---|
| 24 33 168 | 10/1974 | Germany . |
| 2 129 190 | 5/1984 | United Kingdom . |
| 2 141 575 | 12/1984 | United Kingdom . |

*Primary Examiner*—Stephen Avila
*Attorney, Agent, or Firm*—Browdy and Neimark

[57] ABSTRACT

An installation for offshore storage of hazardous waste, in particular radioactive waste comprises (i) a concrete body (11), which is transportable on the water as a floating body and adapted to rest on the seabed at a storage site, said base body being provided with interior storage spaces (S, K) for the waste and at least some of the storage spaces being arranged to be located below the water surface, and (ii) a concrete terminal body (10) which is transportable on the water as a floating body and adapted to rest on the seabed at the storage site, positioned by the side of and adjacent to the base body (11) and connected to the base body. The base body (11) and the terminal body (10) include communication ways (14) adapted to be connected to one another and to the storage spaces (S, K) of the base body, and the terminal body (10) is adapted to have facilities (15, 16) located above the water surface for receiving waste from water or air borne transportation means.

9 Claims, 3 Drawing Sheets

INSTALLATION FOR OFFSHORE STORAGE OF HAZARDOUS WASTE

This application is a national filing under 35 U.S.C. 371 claiming priority from International Application No. PCT/SE96/00624 published Nov. 21, 1996 as International Publication No. WO96/36974.

BACKGROUND OF THE INVENTION

1. Technical Field of the Invention

This invention relates to an installation for offshore storage of hazardous waste, in particular low-active radio-active waste.

2. Prior Art

In many places throughout the world there is a great and pressing need for methods and installations suitable for the storage of large volumes of hazardous waste. As used in this context, "hazardous waste" means dangerously contaminated, infected or otherwise dangerous material, that is, material that has to be handled and stored in such a manner that it will be reliably isolated. For example, large amounts of waste is being kept more or less provisionally stored in barrels or other containers which have been attacked by corrosion and which, if not already leaking, may be expected to begin to leak within the next few years.

Radioactive waste is a burning example of hazardous waste and probably is the kind of hazardous waste which, at least for the time being, most urgently calls for the development of a storage system that affords adequate safety and can be given adequate capacity.

OBJECT AND SUMMARY OF THE INVENTION

The present invention aims at providing a system for temporary or terminal storage of hazardous waste, in particular radioactive hazardous waste, and more particularly low-active waste which can be characterised as hazardous waste of low or medium riskiness.

Such hazardous waste exists in many forms, such as soil, sand, water (reactor water);

nuclear reactors or other parts of nuclear power plants;

nuclear submarines, complete or broken down into parts (reactor sections, for example), barrels or other containers containing radioactive material.

As is apparent from these examples, the forms of hazardous waste contemplated here may also include highly active, hot, radioactive material, such as nuclear fuel rods, enclosed in protective canisters or other enclosures such that when so enclosed it may be handled as low-active or medium-active hazardous waste at least for a limited time shorter than terminal storage time.

The state of the art in respect of offshore storage of hazardous waste is illustrated by WO91/05351. This publication discloses a prior art storage installation comprising a storage body in the form of an annular concrete structure adapted to rest in submerged state on the seabed and provided with a number of upwardly open storage spaces, each of which is adapted to accommodate a concrete storage container which in turn encloses the hazardous waste.

In the prior art storage installation the individual storage containers are constructed such that they constitute self-contained storage units, which themselves provide the required structural protection against the enclosed material, such as protection against access and protection against radioactivity.

Moreover, in the prior art installations the individual storage containers are adapted, after having been charged with the hazardous waste and sealed, to be transported, as floating bodies, for example, to the storage body, whereupon they are sunk into the storage body. The sinking is effected by controlled feeding of water into ballast tanks which are empty during the transportation on the water surface.

The installation according to the present invention, has some features in common with the prior art installation, but also differs from it in essential respects.

Thus, in the prior art installation the storage body is primarily a completely submerged offshore storage site for storage containers which themselves essentially provide the structural protection. Accordingly, the additional protection afforded by the storage body mainly resides in the location of the storage body.

In accordance with the invention, on the other hand, the 35 entire protection, or at least a substantial portion of the protection, for the hazardous waste is provided only by the deposition thereof in the storage body at an offshore site.

Moreover, the storage installation according to the invention comprises a terminal body, on which the hazardous waste is received from, for example, water or airborne transportation means, primarily ships, and from which the hazardous waste is transferred to a base body using transport means belonging to the installation, such as conveyors or vehicles.

BRIEF DESCRIPTION OF THE DRAWINGS

The invention will be further elucidated by the following description of an example of a storage installation constructed in accordance with the invention. The installation is illustrated in the accompanying schematic drawings.

DETAILED DESCRIPTION OF THE PREFERRED EMBODIMENTS OF THE INVENTION

Figure 1:
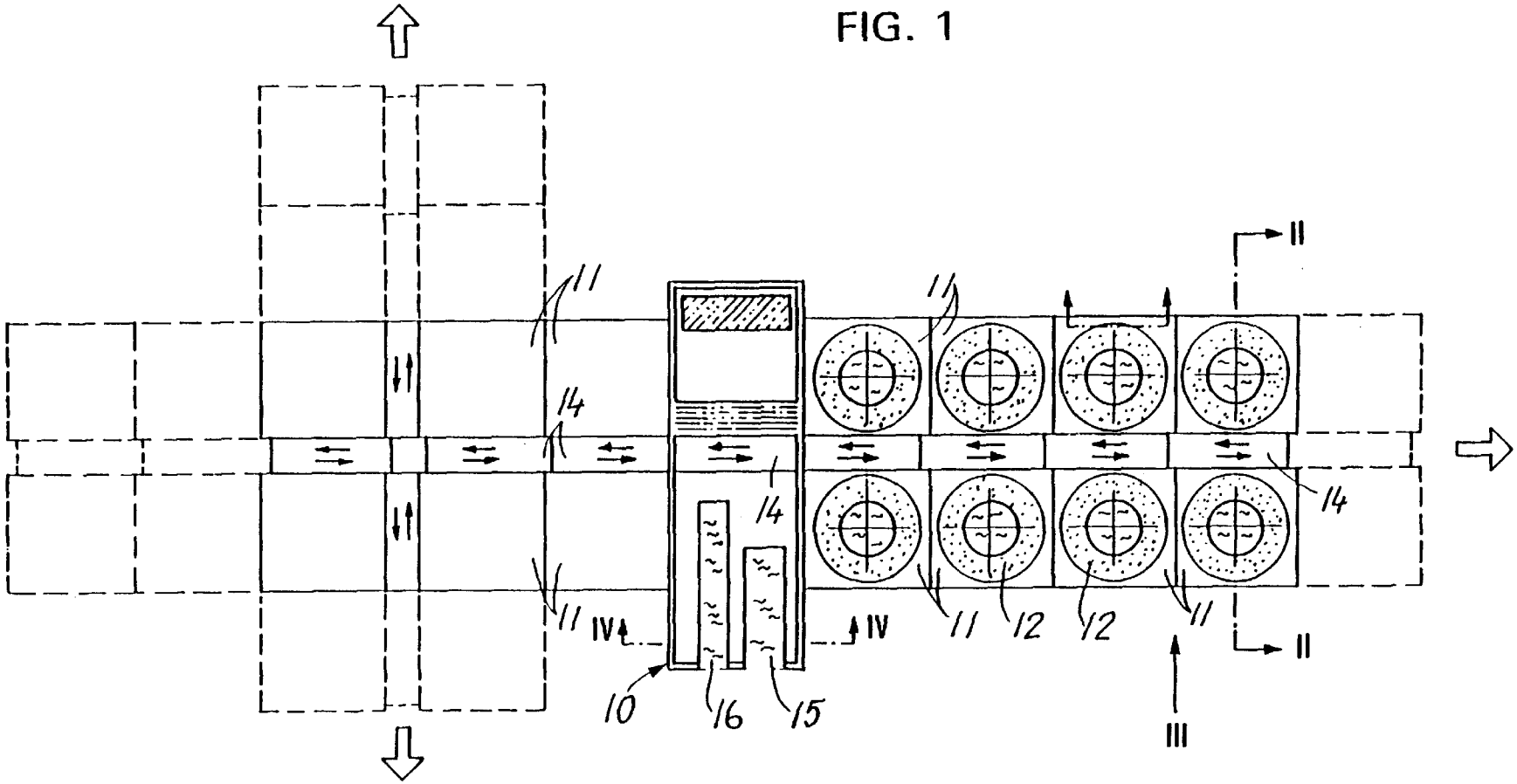
FIG. 1 is a plan view of the installation.

As illustrated in the drawings, the installation comprises a terminal body 10 and a number of storage bodies, hereinafter termed base bodies and designated by 11, which are positioned by the side of the terminal body and side by side with respect to one another. Both the terminal body 10 and the base bodies 11 rest on a bed or other suitable foundation which has previously been prepared on the seabed. Neighbouring bodies are interconnected, such as by tie cables, so that the entire installation constitutes a coherent whole.

The top side of the terminal body 10, or at least a portion of the top side, lies higher than the sea level. This may also apply to the base bodies 11, but these bodies, or at least some of them, may also have their top side lying below the sea level.

On the base bodies 11, or at least some of them, silo-like storage tanks are provided, having at least their top portions well above the sea level.

The terminal body 10 and the base bodies 11, the latter including the storage tanks 12 when these are provided, are the main components of the installation.

The terminal body 10 is a unit for various auxiliary functions, such as receipt of incoming goods to be deposited for storage, dispatch of stored goods to be carried away from the installation, storage of articles of consumption, workshop, housing and administrative functions, surveillance, etc., while the base bodies are units for the actual storage of the hazardous goods, for which the term "storage goods" is frequently used below.

The storage may be terminal storage of low-active waste (for example for a period of 50 years) or temporary storage, pending removal of the storage goods to a terminal storage site. The designation "temporary" as used in this context means that the storage can be for both shorter and longer duration, such as a few years or several decades.

The storage goods are transported from the terminal body 10 to the storage spaces in the base bodies 11. In order that this transportation may be possible, communication ways are provided which interconnect the terminal body and the storage spaces in the base bodies. These communication ways may be formed by elongate sections 14 which are inserted between neighbouring base bodies 11 and define transportation ways for carrying traffic by motor vehicles, tracks for carrying railbound cars, trains or the like, conveyors of various types, pipe lines, chutes, etc. Different types of communication ways and transportation means can be combined.

Figure 2:
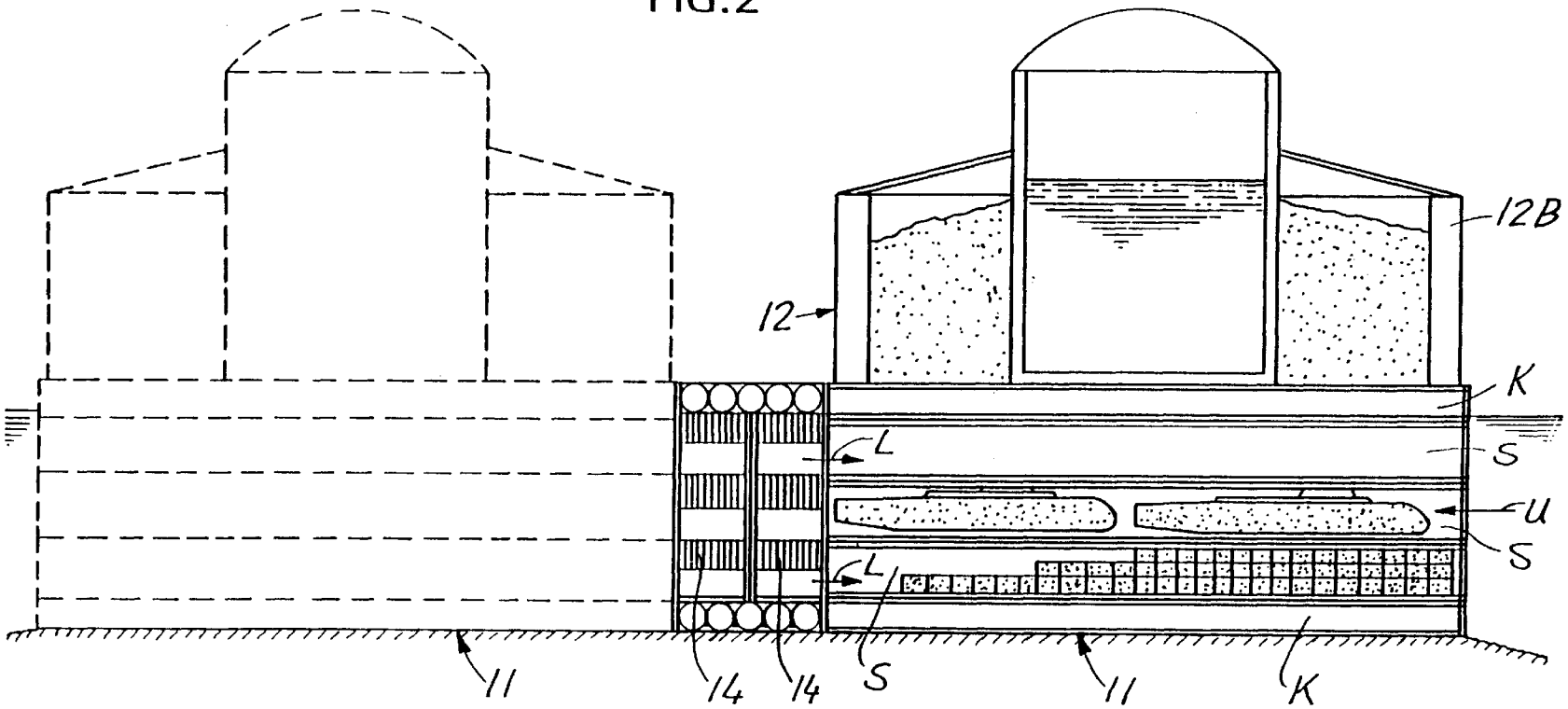
FIG. 2 is a vertical sectional view on line II—II of FIG. 1.
Figure 4:
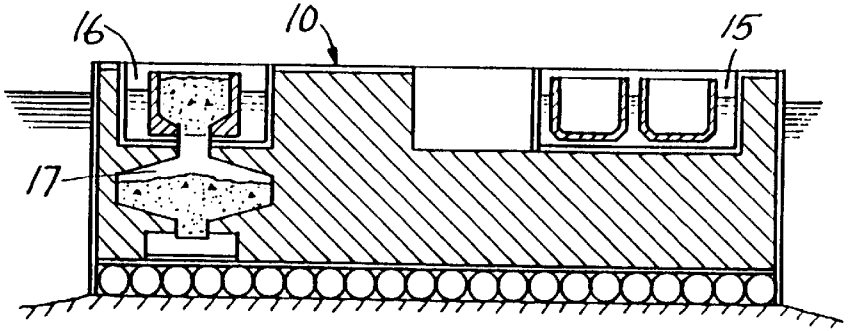
FIG. 4 is a vertical sectional view on line IV—IV of FIG. 1.

In FIGS. 1 and 2, sections 14 defining main communication ways are arranged such that they connect all base bodies 11 with the terminal body 10. From these main communication way sections 14 the individual storage spaces S in the base bodies 11 are accessible through lateral passages. Arrows L in FIG. 2 indicate such access to the storage spaces S.

As is apparent from FIG. 1, a storage installation according to the invention can readily be expanded to increased storage capacity by adding more base bodies 11. If required, one or more additional terminal bodies 10 may then also be added.

Preferably, the base bodies 11 are made as monolithic concrete blocks having horizontal dimensions (length, width) of, for example, 200×200 meters. They may be produced using slip-form concrete construction techniques, suitably in an offshore installation which may be constructed in accordance with the principles described in U.S. Pat. Nos. 3,249,664, 3,686,886, and 4,556,002.

The individual base body 11 may simply be characterised as being a rectangular concrete slab. In the illustrated embodiment this slab has an intermediate portion 11A comprising three storeys of cylindrical, parallel storage compartments S extending throughout the base body from one side thereof to the opposite side, a top portion 11B and a bottom portion 11C having similar but smaller compartments K.

The thickness or height of this concrete slab is determined by the number of storeys of storage compartments S and the height of each such storey and by the heights of the top portion and the bottom portion and may be on the order of 100 m for the above-stated width and length dimensions.

After the concrete slab has been produced, in upstanding position with the storage compartments extending in the vertical direction, and brought to horizontal floating position on the water by rearranging ballast (water) in spaces used as ballast tanks, it may be provided with the above-mentioned tank 12 on its top side; this can also be done using slipform concrete construction techniques. In the embodiment shown to the right in FIGS. 1 and 2, the tank 12 comprises an inner tank 12A and an outer tank 12B concentric therewith. These tanks 12A and 12B are intended for storage of bulk goods, such as radioactive water, in the inner tank and soil contaminated with radioactive material in the outer tank.

Tank 12 should be associated with means for catching any leaking material and returning it to the tank or passing it to spaces within the base body 11 provided for the accommodation of such material. These spaces may be, for example, some of the compartments K or other open spaces between these compartments or between the compartments S in the intermediate portion 11A of the base body.

The finished base body 11, with or without tank 12 and provided with means for sealing the compartments S and K (these means, not shown, may be partly permanently sealed and partly openable) is transported on the water to the prepared foundation or bed on the seabed where it is sunk to its intended place and connected to the terminal body or other base bodies.

Figure 3:
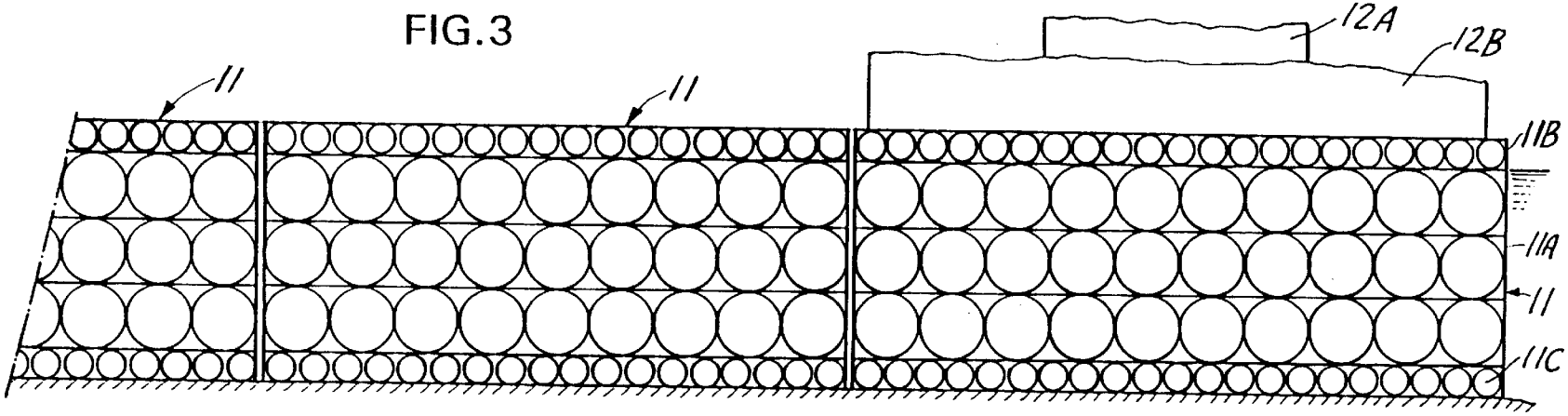
FIG. 3 is a side view of two neighbouring base bodies as viewed in the direction indicated by an arrow III in FIG. 1.
Figure 3A:
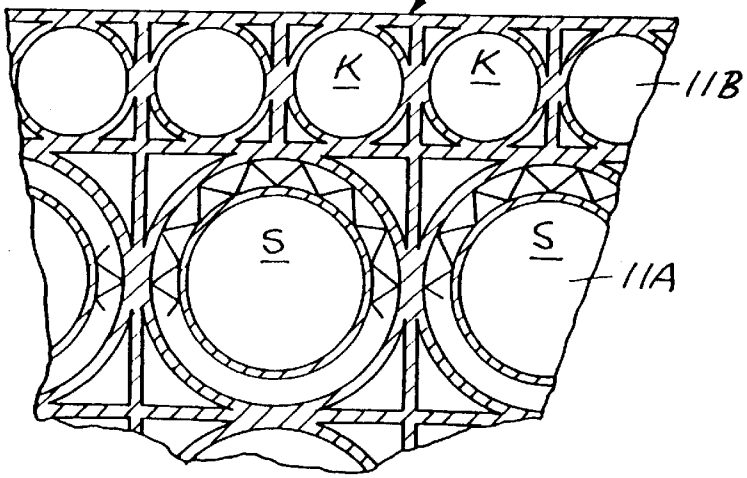
FIG. 3A is an enlarged sectional view on line IIIA—IIIA of FIG. 3 of a portion of the base body.

Suitably, the monolithic base body 11 is made as a shell structure, and an example of such a structure is illustrated in FIG. 3A, drawn to a larger scale, wherein the compartments S in the intermediate portion 11A are defined by the inner wall of a double-walled cylinder shell structure, the outer wall of which is connected with the inner wall through the intermediary of webs. The spaces between the shell walls may be used for collecting material leaking from the tank 12 or the compartments S and provides a possibility of gaining access to the outer side of the inner wall for inspection, repair, etc.

Naturally, the tank 12 is not an indispensable part of the base body according to the invention. Storage goods of the kinds which the tank 12 is intended to accommodate may of course also be stored in the compartments S or K of the base body 11.

The terminal body 10 also comprises a dock 15 with associated quays and loading and unloading means (not shown) by which the storage goods may be unloaded from waterborne transportation means, such as ships or barges. After unloading, the storage goods may be transported to the allocated storage compartment S in one of the base bodies 11 by way of a ramp of other connection to the transportation sections 14. Transportation may also take place using lorries or trucks.

Moreover, the terminal body 10 comprises an unloading installation 16 for receiving storage goods in bulk form, such as radioactive soil or radioactive water. This installation includes a dock for a bottom-dump barge or ship P the dump opening of which may be connected to a gravity shaft 17 from which the storage goods unloaded from the barge or the ship are carried away to a tank 12 in a suitable manner, such as by vehicles and/or conveyors.

A part of the terminal body 10, in FIG. 1 that part which is separated from the dock 15 and the unloading installation 16 by an intervening transportation section 14, serves as housing, workshop, administration and monitoring spaces. During the production of base bodies, the terminal body may also be used as a concrete station and as reception area for all incoming goods used for the production of base bodies.

All reception or dispatch of the storage goods need not take place at the terminal body. The design of the base bodies 11 according to the invention makes it possible and convenient to receive certain types of storage goods from the water direct through one end of one or more storage compartments S, and to this end these compartments are equipped with openable hatches (not shown). In this way, entire submarines, if desired without turret, or at least submarine sections containing nuclear reactors, may be received direct from the water. This way of receiving goods is diagrammatically indicated by an arrow U in FIG. 2.

I claim:

1. An installation for offshore storage of hazardous waste, in particular radioactive waste, comprising a concrete base body (11), which is transportable on the water as a floating body and adapted to rest on the seabed at a storage site, said base body being provided with interior storage spaces (S, K) for the waste and at least some of the storage spaces being arranged to be located below the water surface, a concrete terminal body (10) which is transportable on the water as a floating body and adapt ed to rest on the seabed at the storage site by a side of and adjacent to the base body (11) and to be connected to the base body, and communication ways (14) associated with the base body (11) and the terminal body 10 and adapted to be connected to one another and to the storage spaces (S, K) of the base body, wherein the terminal body (10) is adapted to have facilities (15, 16) located above the water surface for receiving waste from water or air borne transportation means.

2. An installation as claimed in claim 1, characterised in that at least one of the storage spaces (S, K) of the base body (11) has an access opening (U) which extends through a lateral surface of the base body and is sealable by means of a hatch.

3. An installation according to claim 1, characterised in that the base body (11) is provided on the top side thereof with a waste-accommodating space (12) which is situated above the water surface and encircled by an imperforate wall.

4. An installation according to claim 3, characterised in that said waste-accommodating space comprises an inner section (12A) delimited horizontally outwardly by an inner wall and an outer section (12B) defined between the inner wall and an outer wall.

5. An installation according to claim 1, characterised in that the base body (11) comprises a plurality of horizontal elongate and parallel cylindrical spaces extending throughout the base body between opposite lateral surfaces thereof, said cylindrical spaces serving as said interior storage spaces (S, K).

6. An installation according to claim 1, characterised by elongate concrete communication bodies (14) which are adapted to be positioned by the side of the base body (11) and the terminal body (10) and to be connected at a long side thereof to the base and terminal bodies and at adjacent ends thereof to one another, the communication bodies having longitudinally extending communication passages communicating with one another and with the storage spaces (S, K) in the base body.

7. An installation according to claim 1, characterised in that the base body (11) is connectable with a second, similar base body such that the communication ways (14) also communicate with the storage spaces (S, K) of the second base body.

8. An installation according to claim 1, characterised in that the terminal body (10) is connectable with at least one additional base body (11) similar to the first-mentioned one, such that the communication ways (14) also communicate with the storage spaces (S, K) of said additional base body.

9. An installation according to claim 1, characterized in that the base body (11) has spaces which are separated from the inner storage spaces (S) and adapted to receive waste escaping from the inner storage spaces.

* * * * *